US006418932B2

(12) United States Patent
Paschal, Jr. et al.

(10) Patent No.: US 6,418,932 B2
(45) Date of Patent: Jul. 16, 2002

(54) CONVERTIBLE PATIENT ISOLATION POD

(75) Inventors: Charles R. Paschal, Jr.; Orlando J. Illi, both of Frederick, MD (US); George W. Haubeil, Front Royal, VA (US); James R. Gauger, Highland Park; Robert L. Mullins, Jr., Hazel Crest, both of IL (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/780,569

(22) Filed: Feb. 12, 2001

(Under 37 CFR 1.47)

Related U.S. Application Data

(60) Provisional application No. 60/181,464, filed on Feb. 10, 2000.

(51) Int. Cl.[7] ..... A61G 15/00
(52) U.S. Cl. ..... 128/845; 600/21
(58) Field of Search ..... 128/845, 846, 128/870; 600/21, 22; 135/128; 5/624, 625

(56) References Cited

U.S. PATENT DOCUMENTS

| | | | | |
|---|---|---|---|---|
| 3,463,159 | A | 8/1969 | Heimlich | 128/350 |
| 4,664,660 | A | 5/1987 | Goldberg et al. | 604/321 |
| 5,342,121 | A | 8/1994 | Koria | 312/1 |
| 5,626,151 | A | 5/1997 | Linden | 128/897 |
| 5,728,041 | A | 3/1998 | Fowler, Jr. | 600/21 |
| 5,887,439 | A | 3/1999 | Kotliar | 62/78 |
| 5,950,625 | A | 9/1999 | Bongiovanni et al. | 128/845 |
| 5,975,081 | A | 11/1999 | Hood et al. | 128/845 |
| 6,001,057 | A | 12/1999 | Bongiovanni et al. | 600/21 |
| 6,003,728 | A | 12/1999 | Elliott | 222/81 |
| 6,241,653 | B1 | 6/2001 | Gauger et al. | 600/21 |
| 6,321,764 | B1 | 11/2001 | Gauger et al. | |

FOREIGN PATENT DOCUMENTS

| | | |
|---|---|---|
| GB | 2 073 280 A | 10/1981 |
| WO | WO 00/38612 A2 | 7/2000 |
| WO | WO 01/05348 A1 | 1/2001 |

OTHER PUBLICATIONS

Stefanek et al., "Emergency Personal Isolation and Containment (EPIC) System," Abstract for Telemedicine in the New Millennium: "Delivery the Promise," 1999.

*Primary Examiner*—Michael A. Brown
(74) *Attorney, Agent, or Firm*—Elizabeth Arwine

(57) ABSTRACT

A convertible isolation pod for an individual patient formed from sealable flexible plastic sheeting including an air intake grommet at the head end and an air exhaust grommet at the foot end of the pod each of the grommets being equipped with a Heimlich valve to provide unidirectional air flow within the pod where the air is filtered to remove contaminants.

20 Claims, 1 Drawing Sheet

CONVERTIBLE PATIENT ISOLATION POD

This application claims priority from U.S. provisional Application Serial No. 60/181,464, filed Feb. 10, 2000.

TECHNICAL FIELD

The present invention is a single patient isolation pod. The inventive pod is for transport of a patient and provides convertibility between a mode protecting the patient against undesired additional exposure to a hazardous environment and a mode protecting against contamination of others by the isolated patient.

BACKGROUND OF THE INVENTION

There are many devices and structures available in the art for isolating a patient for protection against additional exposure to a hazardous environment while monitoring the patient as well as isolating the potentially infectious patient from caregivers to prevent exposure and/or contamination. Many such devices are directed to use in an individual patient who is exposed to ambient contamination from for example, chemical, biological, infectious agent, environmental, and radiation sources. NBC patient wraps (Nuclear, Biological, Chemical) are currently available to medical and military personnel but do not contemplate or provide for access to a wrapped patient by healthcare providers. After applying a conventional chemical wrap, only the face and some of the neck of a patient is visible and readily accessible to the caregiver. Such wraps incorporate relatively unsophisticated boundary barriers and are most commonly used in "Hot Patient/Cold Environment" and "Hot Patient"/"Hot Environment" situations. Much more secure, expensive and unwieldy are microbiological containment systems directed to use with Level 4 biohazards, such as the Vickers Isolette, a containment system used by the U.S. Army Medical Research Institute of Infectious Diseases Aeromedical Isolation Team. Not only is the Vickers Isolette unit expensive, but as is typical of the contemplated functionality of such units, it particularly contemplates a "Hot Patient/Cold Environment" scenario.

Another prior art device, one intended to prevent further harm to a casualty from exposure to a "hot" environment is the transportable life support system disclosed in U.S. Pat. No. 5,626,151. That device, a mobile intensive care for acute management of trauma victims, is highly electronic with sophisticated patient monitoring and environmental control capabilities and is intended for transport of individual casualty, military field.

U.S. Pat. No. 5,975,081 also describes an individual patient, self-contained, transportable life support system. That prior art device contemplates isolation of a patient from a "hot" environment as well as isolation of a "hot patient" from caregivers particularly during transport. The system incorporates substantial and sophisticated electronic monitoring and patient environment controls which are sealed within a chamber established by a transparent, rigid canopy, sealed in an airtight manner to the supporting base. The system includes a self-contained oxygen generator to dispense with the need for communication of air between the isolation chamber and the ambient environment.

A further example of a containment/isolation system is illustrated in U.S. Pat. No. 5,341,121. This device is directed specifically for isolation of a "hot" item/contaminant, e.g., biohazards, infectious cadavers, etc. and contemplates use for transport thereof. More particularly, the structure of the device is established by affixing in a tubular form flexible, transparent, plastic sheeting to comprising flaps/portions including edges sealable with ZIP LOC® closures and incorporating cuffs to receive and retain flexible rods that establish a supporting frame. The resulting enclosure provides a shielded isolation chamber. As disclosed, the isolation device may include access ports incorporating gloves suitable for the intended purpose of the device as well as sealable sample pouches, integrated waste pouches, etc. Although the isolation unit may include iris ports for insertion and removal of articles from the chamber, consistent with the purpose of the unit, it does not disclose or contemplate provisions for maintaining a live patient.

The prior art also contains numerous disclosures of "Cold Patient"/"Hot Environment" protective suits used throughout the military and civilian complexes. However, such suits are not configured to provide a system of connections/switches/valves to provide for nearly instantaneous selection and convertibility between one or the other needs. Furthermore, the prior art does not present a single isolation device capable of use in any of the various scenarios:

Hot Patient/Hot Environment;

Hot Patient/ Cold Environment; and

Cold Patient/Hot Environment.

By selecting the appropriate locations relative to the pod of this invention for structures such as the "glove-box" gloves permits the caregiver ready access to the isolated patient for important interventions such as advanced airway management, regardless of the particular environment of the caregivers. Likewise, the prudent location of the blower unit/control valves/ also ensures against contaminant saturation particularly around the patient's face and minimizes contamination saturation in "dead zones" commonly found in the use of chemical wraps. Furthermore, patient isolation can be achieved rapidly and easily with the invention which contemplates the use of an air impermeable zipper(s) that allows for the patient to be isolated once sealed. Furthermore, the pod according to this invention may include handles (plastic, fabric, etc.) integrated with the patient support to facilitate patient manipulation particularly in the case of field use in a hostile environment without the need of ancillary equipment such as a stretcher.

SUMMARY OF THE INVENTION

It is the object of the present invention to provide an individual patient contamination isolation pod that overcomes problems and improves over the teachings of the prior art.

It is also an object of this invention to provide effective short term, emergency patient isolation for either Hot Patient/Cold Environment and Cold Patient/Hot Environment.

The invention provides a patient isolation system that permits health care providers relatively unencumbered access to the isolated patient.

It is an object of the invention to improve delivery of advance medical procedures and airway management.

It is another object of the invention to provide a pod with a convertible ventilation system that is easily reconfigured by use of one way airway valves disposed at each end of the pod.

Another object of this invention is to provide an emergency, short-term, single patient, isolation pod utilizing lightweight materials and airtight sealing.

These and other objects of the invention are satisfied by an isolation pod for an individual patient, comprising:

a flexible, transparent air impermeable sheet like member defining at least a first and second end, said first end and said second end being spaced apart, said sheet-like member including a first and a second edge, said first edge area defining a first member of a cooperating sealing element and said second edge area defining a second member of said cooperating sealing element where contacting said first and second edges establish said cooperating sealing element to provide an airtight seal, said first end incorporating a first integrated selectively sealed grommet, said grommet defining an opening and sealed with a one way flow directional valve for directing air flow into the pod and said end including a second end incorporating a second integrated selectively sealed grommet defining an opening and sealed with a one way flow directional valve for directing air flow out of the pod, each of said grommet openings having select cross-sectional dimensions;

an air blower including an elongated nozzle having a cross-sectional dimension corresponding to that of said grommet openings, said nozzle being insertable into said grommet openings for establishing an airtight seal therewith, said air blower having an air port configured to receive and retain an air filter said air blower for selectively communicating filtered air with respect to the interior of the pod.

Still other objects of the invention are provided by a method of isolating an individual patient from the ambient environment comprising the steps of:

determining the status of the patient;

placing the patient in a sealable pod;

sealably securing a select filter on an air blower;

securing the air blower in an aperture selected on the basis of the status of the patient;

activating the air blower for unidirectional airflow into, through, and out of the pod; and sealing the patient within the pod.

Based on these capabilities, the invention herein is readily operational in virtually any ambient environment and provides for utilization in both hot (contaminated) and cold environments with patients that are hot (contaminated or infectious) or have been exposed to a hot environment.

In part, owing to its ability to provide patient containment and isolation (relative to both the patient's environment and that of the caregiver), the invention has particular utility in rescue and lifesaving operations involving a wide range of transport (aircraft, land vehicles, hospital gurneys, etc.). Furthermore, the invention is lightweight, compact, and easily stored in a minimum of space and thereby allows for convenient storage when not in use but ready accessibility to rescue personnel upon need. Consequently, the invention provides multiple benefits permitting low cost, compact storage, easy on-site deployment, effective and efficient patient isolation using minimal space and minimal time, and providing quick configuration to meet the particular isolation requirements of the scenario and disposability.

The invention herein provides for enhanced isolation and treatment system reliability and maintainability while simultaneously minimizing risk of additional injury to both the patient and the caregiving personnel. Additionally, the invention herein, when used properly, reduces the risk of unnecessary contamination of others (particularly where an infectious agent is involved) during medical treatment. The invention design contemplates provision of both effective individual patient isolation and engineering to provide access to the isolated patient and ease of operation by providing sufficient clearance to permit advanced airway manipulation and other medically necessary procedures to occur.

The inventive isolation pod described herein provides a system that meets demanding patient isolation operational requirements, for example, isolation of a casualty resulting from nuclear, biological and/or chemical contamination.

In short, the invention herein, is directed particularly to a convertible, easily deployable, single patient, lightweight, inexpensive, disposable, patient isolation pod providing both maximum transportability and patient isolation while requiring minimum storage space.

The foregoing and other objects and advantages will appear from the description to follow. In the description, reference is made to the accompanying drawing which forms a part hereof, and in which is shown by way of illustration a specific embodiment in which the invention may be practiced. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawing in which.

DETAILED DESCRIPTION OF THE ILLUSTRATED EMBODIMENT

Figure 1:
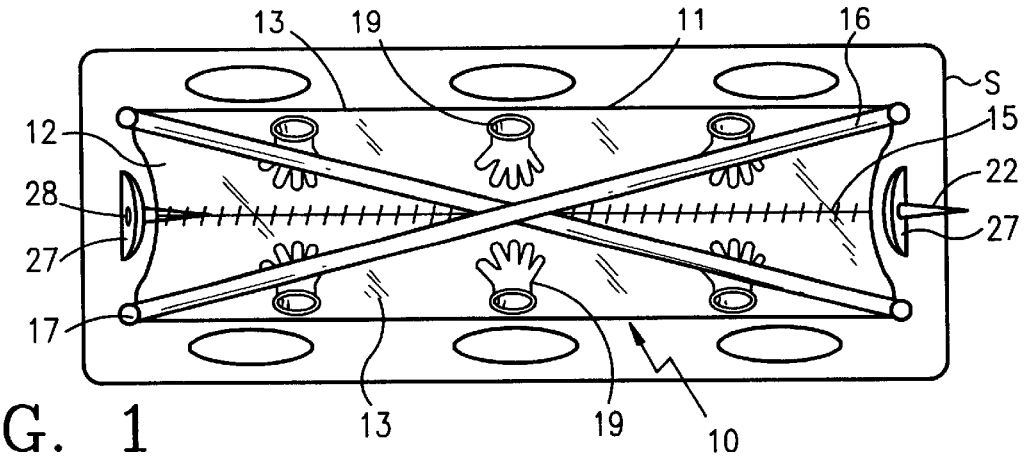
FIG. 1 is a top view of an isolation pod according to the present invention.

Referring now to the figures and, in particular, to FIG. 1 there is shown an emergency personal isolation and containment (EPIC) pod 10 according to the invention. The pod 10 is formed from plastic sheeting 11 in the form of an elongated tube 12 which is split longitudinally to provide an essentially bifurcated shell defined by tube halves 13 sized to facilitate patient introduction into and extrication from the pod 10 by emergency personnel or other caregivers. The pod 10 is depicted on stretcher S.

The tube 12 is constructed from transparent, preferably colorless, air impervious polymeric sheet material 11, as, for example, as a heat sealed vinyl coated polymeric sheet of the type use in a X-Ray transparent, lightweight films or substantially gas impervious polyethylene. Performance criteria of the material of sheet 11 includes tear and puncture resistance proof in field use situations, but also that the material be relatively lightweight, easily collapsible, flexible, and generally translucent but preferably transparent to conventional non-invasive diagnostic instrumentalities (X-Ray, MRI, ultrasound, etc.).

The sheet-like material should be of a selected thickness to be e.g., 5–25 mils. The polymeric sheet material 11 preferably includes reinforcing elements to the underside/patient supporting segment of the pod 10 to increase strength for augmented patient retention confidence and tear/puncture resistance. Such reinforcing elements may be in the form of ribs formed on or extruded directly with the sheet material during formation or incorporation of reinforcing strips.

The seam 15 formed along the edges of the shell halves 13 and 14 are sealed. Preferably, the seam is established by a conventional air-tight, molded/co-extruded, interlocking, plastic tongue-in-groove seal of the well-known ZIP-LOC® type shown in U.S. Pat. No. Re. 28,969, (the content of which is incorporated herein by reference). To facilitate sealing and unsealing of the patient within the pod, preferably, the interlock arrangement includes a Zipper-like slide to apply local pressure on the tongue and groove portions of the interlock to effectively hermetically seal the seam edges together. Use of any number of other edge sealing techniques can also be employed as, for example, using confronting, complementary strips of waterproof, pressure-sensitive adhesives formed along the edges. is known. Although many such pressure-sensitive adhesives are known, those used for example in the formation of disposable diapers which typically are formed of block copolymers of styrene and an elastomeric component, combined with a liquid hydrocarbon resin tackifier possess adequate strength and water-resistant properties for use herein. Such tape closures, similar to those utilized in disposable diapers, typically include a strippable covering that shields the adhesive until used.

A lightweight support frame is established by the placement of flexible rods 16 passed through plastic loops 18 formed at select locations on the exterior of the tube 12. The rods 16 are of conventional construction such as those employed for tents and self-expandable lightweight fabric structures. Cuff pockets 17 disposed at the exterior four corners of the pod at the periphery of the patient bearing surface and sized to receive and secure the ends of the rods 16. The plastic loops 18 are integrally formed on or anchored to the exterior of the tube by heat sealing, adhesives, or other conventional techniques. Although it is preferred to deploy the supporting flexible rods 16 on the outside of the pod (allowing for reuse of the rods notwithstanding the disposal of the tube 12, the pod may include interiorly disposed rods. Notably, in a cold patient/hot environment scenario, the use of a frame may be superfluous as the practical result of the presence of positive/inflation air pressure that will maintain inflation of the patient containing isolation pod 10. In the case of a hot patient/cold environment, the opposite occurs. Due to evacuation of air from the interior of the pod, a negative pressure can develop which would collapse the unsupported tube 12 about a patient sealed therein. Consequently, the use of a supporting frame is desirable.

Figure 4:
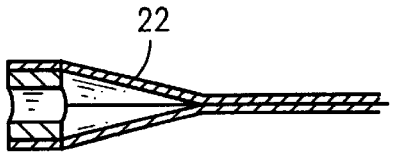
FIG. 4 is cutaway side view of a Heimlich valve.

A significant inventive aspect of the pod resides in the establishment of reinforced, iris type, sealed grommetted feedthroughs 14 at each end of the pod 10. Each of the feedthroughs includes a reinforcing plastic grommet 20 and a one way Heimlich style valve 22 which is illustrated in greater detail in FIG. 4. Heimlich valves, permitting fluid flow in only one direction, are well known and are disclosed in U.S. Pat. No. 3,463,159 and the subject matter of which is incorporated herein by reference. In view of their structural and operational simplicity, Heimlich valves provide efficient fluid flow (in this case air) at a minimal setup and cost. Thus, consistent with the intention and objectives of the present invention Heimlich valves are particularly suited for incorporation in the instant invention to provide directionally controlled air flow/ventilation within the patient isolation chamber.

As illustrated, the two Heimlich valves are disposed in the same direction. Preferably, the valve 22 positioned at the head end of the pod projects internally to direct air into the pod interior while the valve 22 at the foot end projects exteriorly of the pod 10 to permit air to be exhausted from the chamber.

Figure 5:
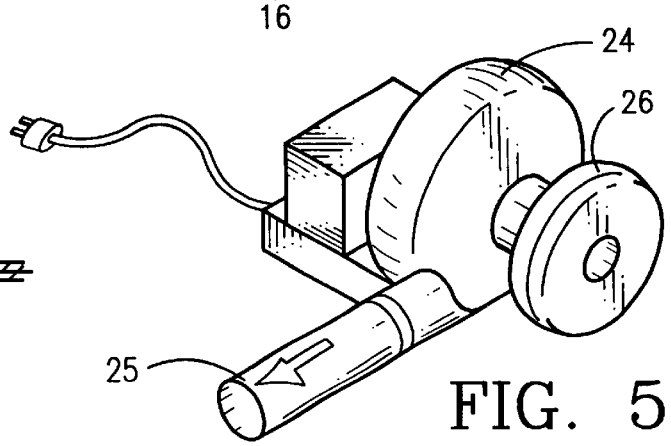
FIG. 5 is a perspective view of a filtered directional blower contemplated for use with the invention.

Air is positively directed through the pod 10 by a portable electrically actuated blower 24 which is depicted in FIG. 5. The blower 24 comprises an electric motor driven pump located within an appropriate housing which incorporates an intake port adapted for a filter cartridge 26 and an exhaust nozzle 25. Preferably, for field use, the blower 24 is battery powered but may be a conventional plug-in type (illustrated). The blower 24 can be equipped with an electric heater for use in a "hot" environment for warming air discharged into the pod tube 12, if desired.

Figure 2:
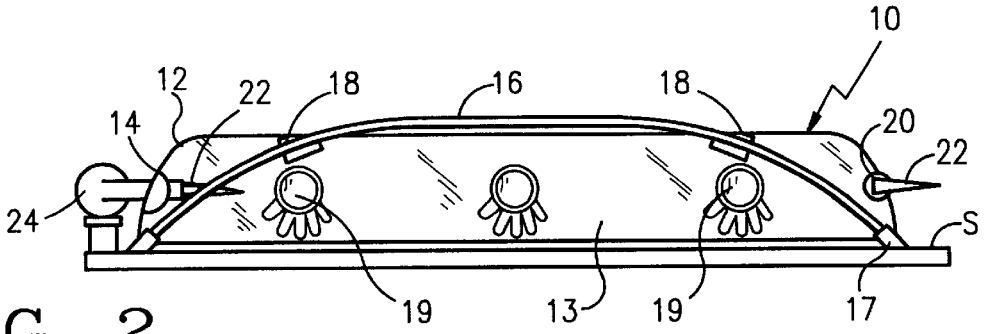
FIG. 2 is a side view of an isolation pod according to the present invention which is configured to isolate a cold patient in a hot environment.

To achieve the isolation objectives of the invention, the filter cartridge comprises a HEPA or NBC (nuclear, biological, chemical) filter for removal of air contaminants in the nanometer range. Consequently, all air taken in by the blower 24 is filtered before it is output through the nozzle 25. The blower nozzle 25 is dimensioned to be sealably inserted into and cooperate with the within the grommet 20 of feedthrough 14 to provide a pneumatic seal. In the case of a hot environment/cold patient, the blower 24 is seated at the head end of the pod 12 as illustrated in FIG. 2. In this manner, filtered air passes through the Heimlich valve 22 and into the pod 12. Once sufficient pressure develops inside the pod, the air exits through the Heimlich valve 22 at the foot end.

In the event of a Cold Environment/Hot Patient, the blower is inserted into the grommet at the foot end to draw air through the Heimlich valve at the head end and into the pod. The air, to which the hot patient has been exposed, is then positively drawn through the filter on the blower intake and exhausted through the downstream Heimlich valve. Because the air has been filtered, the risk of exposure to hazards from the patient to care givers and others in the immediate vicinity is significantly reduced. Thus, the invention achieves a convertible operational objective with a minimum of effort.

To further facilitate caregiver activities such as airway management and the like, the pod 10 includes a plurality of ported isolation tear resistant gloves 19 of conventional construction and composition. The gloves include a reinforced portal and tubular sleeves to allow for patient treatment without exposure of the patient to the ambient.

Figure 3:
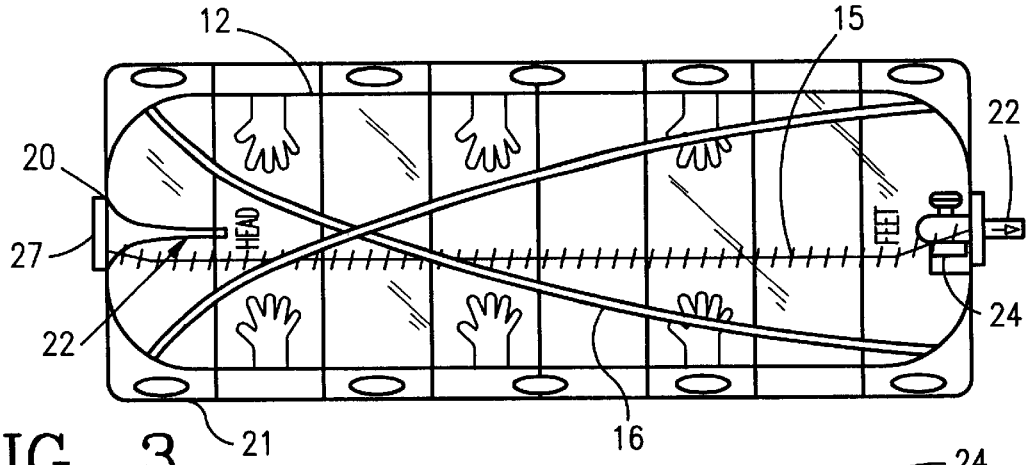
FIG. 3 is a top view of an alternative embodiment of an isolation pod according to the present invention which is configured to isolate a hot patient in a cold environment.

FIG. 3, represents the arrangement of the blower 24 in the case of the hot patient scenario and also depicts an alternative embodiment of the invention. The embodiment of FIG. 3 features a stretcher 21 which integrates the pod 10 between bulkheads 27 disposed on each end of the stretcher 21 projecting upwardly from the stretcher bearing surface. The stretcher complements the structure of the pod 12 by providing grommetted, irised, feedthroughs in the bulkheads 27 which correspond to the feedthroughs 14 of the pod tube 12. The bulkhead feedthroughs thereby provide a sealed passage for the blower nozzle 25. When used, the iris should be of a construction so as to be readily displaceable by the nozzle 25 and thereby permit its insertion into the grommet.

The size and position of the feedthrough bulkheads 27 also preferably correspond to the conformation of the housing of blower 24 where is can nest or otherwise be positionally stabilized when abutting the bulkhead 27 in a confronting relation. The bulkheads may also be used to positionally stabilize a patient isolated within the pod, particularly during extrication and transport.

Reference is made briefly to the structure of the stretcher S. The instant invention contemplates use with most conventional stretcher structures. Conventional stretchers typically incorporate a rigid, upper patient supporting surface with a plurality of handholds disposed about the periphery to facilitate transport and isolated patient manipulation. If desired, an ordinary stretcher S may retrofit with removable or flip-up feedthrough bulkheads 27 exhibiting similar design considerations discussed above.

As used herein, "patient" is intended to embrace human, animal, parts/organs thereof, and other life forms requiring air to live.

Given the foregoing, it should be apparent that the specific described embodiments are illustrative and not intended to be limiting. Furthermore, variations and modifications to the invention should now be apparent to a person having ordinary skill in the art. These variations and modifications are intended to fall within the scope and spirit of the invention as defined by the following claims.

We claim:

1. An isolation pod for an individual patient, comprising:

a flexible, transparent air impermeable sheet member defining at least a first and second end, said first end and said second end being spaced apart, said sheet member including a first and a second edge, said first edge area defining a first member of a cooperating sealing element and said second edge area defining a second member of said cooperating sealing element where contacting said first and second edges establish said cooperating sealing element to provide and airtight seal, said first end incorporating a first integrated selectively sealed grommet, said grommet defining an opening and sealed with a one way flow directional valve for directing air flow into the pod and said end including a second end incorporating a second integrated selectively sealed grommet defining an opening and sealed with a one way flow directional valve for directing air flow out of the pod, each of said grommet openings having select cross-sectional dimensions;

an air blower including an elongated nozzle having a cross-sectional dimension corresponding to that of said grommet openings, said nozzle being insertable into said grommet openings for establishing an airtight seal therewith, said air blower having an air port configured to receive and retain an air filter. said air blower for selectively communicating filtered air with respect to the interior of the pod.

2. The isolation pod of claim 1 where the one way valves are Heimlich valves.

3. The isolation pod of claim 2 where the Heimlich valve disposed at said first end projects into the interior of the pod permitting air delivery into the pod interior and the Heimlich valve disposed at said second end projects exteriorly of the pod for exhausting air from the pod interior.

4. The isolation pod of claim 1 where the air blower selectively injects or exhausts air from said pod.

5. The isolation pod of claim 1 where the air blower has an air intake port and a removable filter sealingly mountable to the air intake port to filter air drawn through the air intake port by the blower.

6. The isolation pod of claim 5 where the air filter is a HEPA filter.

7. The isolation pod of claim 5 where the air filter is an NBC filter.

8. The isolation pod of claim 1 where said sheet color is clear for easy viewing of an isolated patient contained in the pod.

9. The isolation pod of claim 1 where the first and second edges respectively are formed along the sides of said sheet and the edges are hermetically sealable.

10. The isolation pod of claim 1 where said first and second sealing means edges are define a zip lock closure.

11. The isolation pod of claim 1 further including a pod supporting frame formed by flexible rods.

12. The isolation pod of claim 11 further including rod retaining elements disposed at select locations on the exterior of the pod for receiving and retaining the rods to establish the supporting frame.

13. The isolation pod of claim 12 where said retaining elements comprise reinforced pockets and loops.

14. The isolation pod of claim 1 further comprising an integrated patient supporting stretcher.

15. The isolation pod of claim 14 where the stretcher includes apertured bulkheads integrally formed at each end thereof and positioned and dimensioned to cooperate with said first and second grommets for thereon for receiving and supporting the nozzle of said air blower.

16. The isolation pod of claim 1 where the blower is electrically powered and includes a power source.

17. The isolation pod of claim 1 further comprising access gloves including hand and forearm portals integrally formed in said sheet member to facilitate isolated patient care.

18. The method of using the isolation pod according to claim 1 including the step of sealing a patient in the pod.

19. The method of isolating an individual patient from the ambient environment comprising the steps of:

determining the status of the patient;

placing the patient in a sealable pod;

sealably securing a select filter on an air blower;

securing the air blower in an aperture selected on the basis of the status of the patient;

activating the air blower for unidirectional airflow into, through, and out of the pod; and sealing the patient within the pod.

20. The method according to claim 19 further comprising the step of forming a frame to support the pod during patient isolation therein.

* * * * *